US012503814B2

(12) United States Patent
Von Drasek et al.

(10) Patent No.: US 12,503,814 B2
(45) Date of Patent: Dec. 23, 2025

(54) PROCESS TO OPTIMIZE BROWN STOCK WASHING UNIT OPERATIONS

(71) Applicant: ECOLAB USA INC., St. Paul, MN (US)

(72) Inventors: William Von Drasek, Oak Forest, IL (US); Prasad Y. Duggirala, Naperville, IL (US); Dorota Smoron, Bartlett, IL (US); Christopher Powers, Foley, AL (US); David Sirois, Sherwood, WI (US); Khaled Zouaoui, Naperville, IL (US); Michael Kjerulf, Winnipeg (CA)

(73) Assignee: Ecolab USA Inc., St. Paul, MN (US)

( * ) Notice: Subject to any disclaimer, the term of this patent is extended or adjusted under 35 U.S.C. 154(b) by 74 days.

(21) Appl. No.: 17/590,970

(22) Filed: Feb. 2, 2022

(65) Prior Publication Data

US 2022/0251781 A1 Aug. 11, 2022

Related U.S. Application Data

(60) Provisional application No. 63/199,995, filed on Feb. 8, 2021.

(51) Int. Cl.

| | |
|---|---|
| ***D21C 9/00*** | (2006.01) |
| ***D21C 9/02*** | (2006.01) |
| ***D21C 9/10*** | (2006.01) |

(52) U.S. Cl.

CPC ..... *D21C 9/002* (2013.01); *D21C 9/02* (2013.01); *D21C 9/1052* (2013.01)

(58) Field of Classification Search

CPC ..... D21C 9/002; D21C 9/02; D21C 9/1052; D21C 9/04; D21C 9/06

See application file for complete search history.

(56) References Cited

U.S. PATENT DOCUMENTS 4,013,506 A 3/1977 Histed et al.
4,540,468 A 9/1985 Genco et al.
(Continued)

FOREIGN PATENT DOCUMENTS

WO 2020136308 A1 7/2020

OTHER PUBLICATIONS

Thomas Bishop, The Effect of Black Liquor Carr ect of Black Liquor Carryover on Bleaching Effluent er on Bleaching Effluent Chemical Oxygen Demand (COD), Apr. 1994, Wester Michigan University, all, url: https://scholarworks.wmich.edu/cgi/viewcontent.cgi?article=1082&context=engineer-senior-theses (Year: 1994).*
Josephson et al, Brownstock Washer Performance and Control, 1992, Environmental Conference, p. 415-421 (Year: 1992).*
Bender G et al: "Advanced Control for Brown-Stock Washers", Tappi Journal, Technical Association of the Pulp & Paper Industry, Atlanta US, vol. 71, No. 12, Dec. 1, 1988 (Dec. 1, 1988), pp. 115-118.
(Continued)

*Primary Examiner* — Jacob T Minskey
*Assistant Examiner* — Elisa H Vera
(74) *Attorney, Agent, or Firm* — Eric D. Babych; Barnes & Thornburg LLP

(57) ABSTRACT

A method of treating brown stock in a brown stock washing process is provided. The method includes measuring a refractive index of a brown stock; and dosing an additive to the brown stock according to at least the refractive index of the brown stock. A system for controlling dosing of an additive to a brown stock washing process is also provided. The system includes a refractive index measurement device; a controller configured to receive data provided by the refractive index measurement device and transform the data into additive addition output instructions; and an additive delivery unit configured to receive and execute the additive addition output instructions from the controller.

20 Claims, 5 Drawing Sheets

(56) References Cited

U.S. PATENT DOCUMENTS

| | | | | |
|---|---|---|---|---|
| 4,624,742 | A | 11/1986 | Klein et al. | |
| 4,732,651 | A | 3/1988 | Lisnyansky et al. | |
| 5,220,172 | A | 6/1993 | Berthold et al. | |
| 5,420,682 | A | 5/1995 | Haggerty et al. | |
| 5,486,915 | A | 1/1996 | Jeffers et al. | |
| 5,953,111 | A | 9/1999 | Millar et al. | |
| 6,052,177 | A | 4/2000 | Millar et al. | |
| 6,069,688 | A | 5/2000 | Millar et al. | |
| 6,074,522 | A | 6/2000 | Seymour | |
| 7,812,947 | B2 | 10/2010 | Shakespeare et al. | |
| 9,371,613 | B1 | 6/2016 | Lobo et al. | |
| 10,450,700 | B2 | 10/2019 | Bicho et al. | |
| 10,481,127 | B2 | 11/2019 | Xiong et al. | |
| 11,072,890 | B2 * | 7/2021 | Mackie ..... | D21H 21/10 |
| 2018/0187376 | A1 | 7/2018 | Mackie et al. | |

OTHER PUBLICATIONS

International Search Report and Written Opinion for International Application No. PCT/US2022/014850, mailed May 11, 2022, 16 pages.

Kopra Riku et al: "Effect of Defoamer on the Gas Content and Performance of O2 washers—Mill Case Study", Oct. 30, 2019 (Oct. 30, 2019), pp. 1-25.

Kopra et al: "Application of the refractometer in the measurement and monitoring of brown stock washing, doctoral dissertation", Jan. 1, 2015 (Jan. 1, 2015).

Tang, W., & Shan, W. J. (2011). Application of the Predictive and Inferential Control to Pulp Washing Process. In Applied Mechanics and Materials (vol. 65, pp. 62-65). Trans Tech Publications, Ltd. https://doi.org/10.4028/www.scientific.net/amm.65.62.

* cited by examiner

PROCESS TO OPTIMIZE BROWN STOCK WASHING UNIT OPERATIONS

BACKGROUND

1. Field of the Invention

The present disclosure generally relates to treating brown stock and improving washing of brown stock. More particularly, the disclosure relates to a method of controlling the brown stock washing process by measuring the refractive index of the brown stock.

2. Description of the Related Art

The term "brown stock" refers to a slurry comprising generally unbleached pulp that is fed to a brown stock washer. Brown stock includes pulp and water (i.e., pulp slurry), and may further comprise, for example, black liquor solids present due to countercurrent washing. Generally, brown stock is washed to remove black liquor solids from the unbleached pulp prior to, for example, bleaching the pulp and/or feeding the pulp to a papermaking process, and to reduce conductivity of the pulp mat to improve efficiency of downstream bleaching. Additionally, brown stock washing helps reduce soda loss and organics in brown stock processing, which generally promotes efficiency in processing.

Brown stock unit operation is important and a crucial stage in the entire pulp mill operations. For the purposes of brown stock washing, it is known in industrial practice that effective drainage and washing of pulp fibers is desired in addition to defoaming.

Generally, entrained air impacts brown stock washer operation and, therefore, wash aid consumption. Control of wash aids (e.g., drainage aid, defoamer) to a brown stock washing process ranges from manual control where pump flows are changed at a single wash aid pump with no higher level (e.g., feedback) control, to other control systems that utilize only measured entrained air data to control dosing of a single, pre-blended wash aid.

Many brown stock washing processes utilize manual control. For these processes, pumps are set manually at a given flow rate and have no interface with the brown stock washing process. Generally, chemical feed rates are constant until the operator manually alters the pump speed, and therefore the flow rate. In some cases, changes in flow rate will be made during upset conditions and left at the changed flow rate for an extended (i.e., excessive) period of time.

Another control method that is commonly utilized in brown stock washing processes is simple "pounds per ton" control, i.e., pounds of wash aid dosed per ton of dry pulp. For "pounds per ton" processes, the brown stock washing process control system calculates a pounds-of-wash-aid-per-ton-of-dry-pulp setpoint and then controls washing aid dosage based on the setpoint. "Pounds per ton" control does not base its wash aid dosage control on changes in either measured entrained air concentration data or changes in fiber characteristics that may impact drainage.

BRIEF SUMMARY

A method of treating brown stock in a brown stock washing process is provided. The method includes measuring a refractive index of a brown stock; and dosing an additive to the brown stock according to at least the refractive index of the brown stock.

In some aspects, the method includes measuring a conductivity of the brown stock.

In some aspects, the method includes determining total dissolved solids from the refractive index of the brown stock.

In some aspects, the method includes determining a total black liquor carryover in the brown stock based on at least two variables: the refractive index of the brown stock and the conductivity of the brown stock.

In some aspects, the total black liquor carryover comprises an organic fraction and an inorganic fraction.

In some aspects, the organic fraction is determined using a formula that is a function of the conductivity of the brown stock and total dissolved solids in the brown stock.

In some aspects, the additive comprises a drainage aid.

In some aspects, the drainage aid comprises a surfactant, a defoamer, a solvent, or combinations thereof.

In some aspects, the additive comprises a defoamer.

In some aspects, the defoamer comprises a hydrocarbon, an oil, a fatty alcohol, a fatty ester, a fatty acid, a poly (alkylene oxide), an organic phosphate, hydrophobic silica, a silicone-containing compound, and combinations thereof.

In some aspects, the defoamer comprises a silicone-containing compound.

In some aspects, the silicone-containing compound is a polydimethylsiloxane-containing compound.

In some aspects, the method includes determining a chlorine dioxide dosage in a bleaching stage of a papermaking process based on the total black liquor carryover.

In some aspects, the brown stock washing process comprises a plurality of washers arranged in series.

In some aspects, the method includes measuring the conductivity and the refractive index of the brown stock being fed to a first washer in the plurality of washers and measuring the conductivity and the refractive index of washed pulp leaving a last washer in the plurality of washers.

A system for controlling dosing of an additive to a brown stock washing process is provided. The system includes a refractive index measurement device; a controller configured to receive data provided by the refractive index measurement device and transform the data into additive addition output instructions; and an additive delivery unit configured to receive and execute the additive addition output instructions from the controller.

In some aspects, the system further comprises at least one of a vat level detector, a shower flow measurement device, a shower conductivity measurement device, a drum thickener electrical current relay, an entrained air and bubble size detector, and combinations thereof, in communication with the controller.

In some aspects, the system includes a conductivity measurement device configured to measure conductivity of the brown stock.

In some aspects, the controller is configured to determine a total black liquor carryover in the brown stock based on at least two variables: a refractive index of the brown stock and a conductivity of the brown stock.

In some aspects, the additive delivery unit comprises a pump.

In some aspects, the controller stores a formula that is a function of conductivity of the brown stock and total dissolved solids in the brown stock.

The foregoing has outlined rather broadly the features and technical advantages of the present disclosure in order that the detailed description that follows may be better understood. Additional features and advantages of the disclosure will be described hereinafter that form the subject of the claims of this application. It should be appreciated by those skilled in the art that the conception and the specific embodiments disclosed may be readily utilized as a basis for modifying or designing other embodiments for carrying out the same purposes of the present disclosure. It should also be realized by those skilled in the art that such equivalent embodiments do not depart from the spirit and scope of the disclosure as set forth in the appended claims.

BRIEF DESCRIPTION OF THE SEVERAL VIEWS OF THE DRAWINGS

A detailed description of the invention is hereafter described with specific reference being made to the drawings in which.

DETAILED DESCRIPTION

Figure 1:
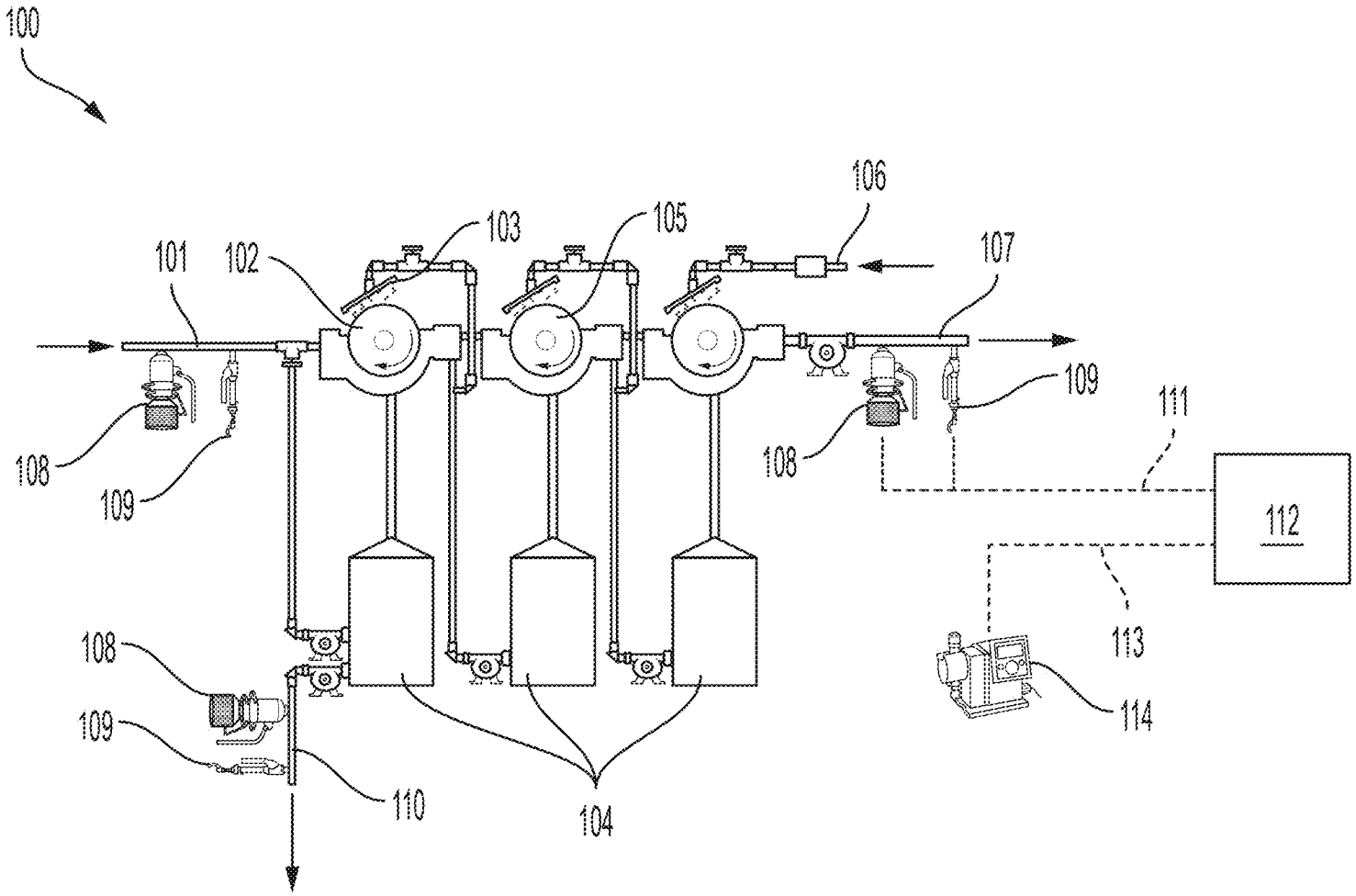
FIG. 1 shows a schematic for an embodiment of a system for treating and washing brown stock.

Various embodiments are described below with reference to the drawings in which like elements generally are referred to by like numerals. The relationship and functioning of the various elements of the embodiments may better be understood by reference to the following detailed description. However, embodiments are not limited to those explicitly described below. It should be understood that the drawings are not necessarily to scale, and in certain instances details may have been omitted that are not necessary for an understanding of embodiments disclosed herein, such as—for example—conventional fabrication and assembly.

The methods and systems described herein are related to treatment of brown stock. The term "brown stock" is a term of art that refers to a slurry comprising generally unbleached pulp that is fed to a brown stock washer. Brown stock comprises pulp and water liquor (i.e., pulp slurry), and may further comprise, for example, black liquor solids present due to countercurrent washing. Generally, brown stock is washed to remove solids (e.g., black liquor solids) from the unbleached pulp prior to, for example, bleaching the pulp and/or feeding the pulp to a papermaking process, and to reduce conductivity of the pulp mat to improve efficiency of downstream bleaching. Additionally, brown stock washing helps reduce soda loss in brown stock processing, which generally promotes efficiency in processing as related to soda consumption.

Brown stock washers include, but are not limited to, chemiwashers, displacement drum washers, horizontal belt washers, rotary pressurized drum washers, compaction baffle washers, twin-roll presses, and screw presses. Depending on the washer used in the brown stock washing process, different variables may be controlled or monitored to optimize the process. For example, in a chemiwasher, the feed consistency, air entrainment, forming and stage vacuums, stage shower flows, wire speed, liquor solids levels, and final dilution may be monitored.

The pulp in the brown stock may be derived from hardwoods, softwoods, or a mixture thereof. The methods described herein are effective in treating brown stock containing hardwood, softwood, or mixtures thereof.

Generally, brown stock washing is performed via a brown stock washing process that comprises a brown stock being delivered (e.g., flowed) to a brown stock washer drum rotating at a brown stock washer drum speed. The brown stock comprises pulp slurry, and the pulp slurry is taken up by the rotating brown stock washer drum. Treatment in the form of, among others, drainage aid, defoamer, or both drainage aid and defoamer are delivered to the pulp slurry via one or more pumps. The brown stock washing process may be performed in stages (e.g., delivery of one treatment, followed by delivery of a second treatment that may be the same or different) on a plurality of brown stock washer drums. The brown stock washing process may be repeated one or more times. Generally, after completing the brown stock washing process, the pulp slurry proceeds to a bleaching plant for bleaching. In certain embodiments of the methods provided herein, the brown stock is washed so as to minimize bleaching costs (e.g., minimize chlorine dioxide consumption and/or hydrogen peroxide consumption).

When the washing is poor, the challenge in the bleach plant operation is to accurately quantify the amount of black liquor carryover, because it affects the first stage of bleaching process. At present, most mills rely on conductivity or chemical residual after chlorine dioxide addition to determine black liquor carryover. These are, at best, surrogate measurements in place of directly quantifying dissolved lignin. Conductivity is based on the measurement of the ionic sodium species in the liquor, inorganic phase does not directly measure the organic phase, which includes dissolved lignin. An oftentimes equally important but neglected component is the dissolved or filtrate lignin moving through the process, which also can vary widely and consume a significant portion of bleaching chemicals.

A method of treating brown stock in a brown stock washing process is provided. The method includes measuring a refractive index of a brown stock; and dosing an additive to the brown stock according to at least the refractive index of the brown stock.

Figure 2:
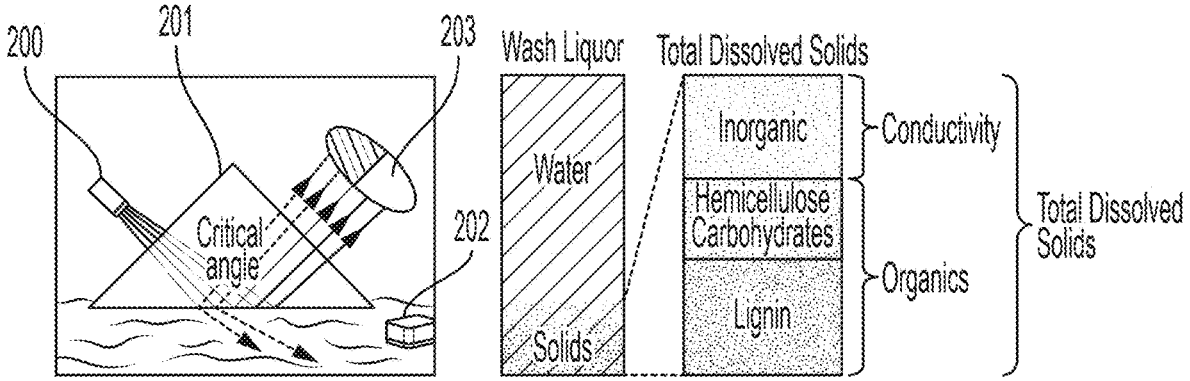
FIG. 2 shows conceptual schematic of using the refractive index to determine the total dissolved solids in the wash liquor.

The performance of brownstock washers is mainly monitored in the industry via the variations in the levels of conductivity measurements. However, conductivity reflects only on the inorganic fraction of the black liquor, but not the total black liquor in the brown stock. The measurement of total dissolved solids (TDS) is often used to express washing loss, without specific differentiation between organic and inorganic fractions. A refractometer can be used to measure the refractive index of the brown stock to determine the TDS. The present application describes a method of minimizing downstream carryover by monitoring both organic and inorganic fractions of washing liquor. The multivariable model development shown in FIG. 2 shows conceptually the measurement of the refractive index and that the dissolved solids include an inorganic fraction and an organic fraction. A monochromatic light source 200 illuminates a prism 201 and an optical image 203 is produced from which properties of the process medium 202 can be derived. The model provides a new control methodology on washing, which will allow the industry for pump control with organic wash aid chemistry.

In some aspects, the method includes measuring a conductivity of the brown stock. The manner in which conductivity is measured is not particularly limited. The conductivity, for example, may be measured using a probe and a meter where the probe is immersed in the water. The conductivity probe may transmit measurements wirelessly or through a wired connection to a controller. The conductivity measurement is used to determine the inorganic fraction of the TDS in the wash liquor portion of the brown stock.

The inorganic fraction may be determined using a multiple regression model using TDS and conductivity. For example, the predicted inorganic weight percent may be calculated according to Formula I:

$$\text{Inorganic (\% wt.)} = \text{Constant} + B^{*}\text{Conductivity (mS/cm)} + A^{*}\text{TDS (\% wt.)} \qquad \text{Formula I}$$

where A and B are parameters determined from a fit of the data to gravimetric measurements of the brown stock.

To determine TDS in the wash liquor, the organic fraction is measured using the refractive index of the brown stock. The organic fraction of the TDS comprises hemicellulose, carbohydrates, and lignin. With the conductivity and refractive index, the inorganic and organic fractions of the TDS can be determined. The inorganic and organic fractions constitute the total black liquor carryover in the brown stock.

The organic fraction may be determined using a formula that is a function of the conductivity of the brown stock and total dissolved solids in the brown stock. For example, a multiple regression model may be used to calculate the organic fraction. Formula II may be used to calculate the predicted organic weight percent:

$$\text{Organic (\% wt.)} = \text{TDS (\% wt.)} - \text{Predicted Inorganic (\% wt.)} \qquad \text{Formula II}$$

Several variables can be monitored in the brown stock washing process, each variable providing information related to the state of the process. For example, operators of a brown stock washing process may monitor brown stock washer drum speed and/or brown stock washer stock flow to determine how quickly (or alternately, how slowly) the pulp of the brown stock washing process is being washed. A typical operator of a brown stock washer process may not utilize the retrieved data to control the process, but merely collect the data to provide information as to the general production of washed pulp.

Certain aspects of the methods provided herein utilize, in addition to conductivity and refractive index, the brown stock washer drum speed, the brown stock washer stock flow, and/or entrained air measurements to independently dose drainage aid and defoamer to pulp of the brown stock washing process. In some aspects, the data gathered is used at least in part to control dosage of drainage aid, defoamer, or both drainage aid and defoamer.

An excessive amount of entrained air present in the pulp slurry can cause difficulty downstream from the brown stock washing process. For example, as entrained air forms in the washer vat or on the washer mat, drainage of the filtrate through the washer mat can be impacted. In addition, foam can grow rapidly without defoamer being dosed to the pulp slurry of the brown stock washing process, which can result in the foam causing overflow of the washer vat and/or filtrate tanks. Furthermore, cavitation of process pumps can be caused by the presence of excess entrained air in the pulp slurry.

Entrained air can be measured, for example, via an entrained air measurement device. An example of an entrained air measurement device is a Nalco Water 4D Air entrained air detection system. In certain embodiments of the methods provided herein, defoamer is dosed to the pulp of the brown stock washing process such that the measured entrained air is maintained at from 0 to about 20% of saturation based on mill conditions.

While the aforementioned setpoint is one example of a setpoint, the term "setpoint" should be construed to include any control value or control range where a measurement (e.g., measured conductivity and/or refractive index) is compared to a preselected or calculated control value or range thereof.

Generally, the brown stock washer drum speed is monitored as part of the brown stock washing process. A brown stock washer drum is generally cylindrical, having a diameter of from about 8 ft to about 15 ft, and a length of from about 10 ft to about 40 ft, providing a drum surface of from about 250 $ft^2$ to about 2000 $ft^2$ for pulp to contact. A brown stock washing process may have a brown stock washer drum speed of from about 1 rpm to about 5 rpm, or from about 1 rpm, or from about 2 rpm, to about 4 rpm, or to about 5 rpm.

Generally, brown stock washer stock flow is monitored as part of the brown stock washing process. Brown stock washer stock flow refers to the amount of pulp slurry that is being delivered to the brown stock washer drum. Ideally, brown stock washer stock flow is maintained at a rate that is optimal to maximize production while maintaining cost efficiency. Generally, brown stock washer stock flow is maintained so as to provide a brown stock consistency of from about 1% to about 4%, including to about 3.5%. "Brown stock consistency" is a percentage rating describing the amount of pulp in the brown stock slurry. A method for calculating brown stock consistency is as follows: (oven-dry weight of pulp*100)/(weight of pulp including water). Pulp can be oven-dried, e.g., by heating pulp to 105° C. until any water has been evaporated away.

In some aspects, the measured brown stock washer drum speed and brown stock washer stock flow can be compared to determine dosage of drainage aid to pulp in a brown stock washing process. Utilizing the methods provided herein, a setpoint related to brown stock washer drum speed based on brown stock washer stock flow can be determined. The brown stock washer drum speed is compared with the setpoint to determine the drainage aid dosage. If the drum speed is higher than the setpoint, which is based on the stock flow, then the drainage aid dosage is increased accordingly, or if the drum speed is lower than the setpoint then the drainage aid is decreased accordingly.

Additional variables of a brown stock washing process that may be monitored include, but are not limited to, vat level, shower flow, shower conductivity, electrical current of the drum thickener, entrained air bubble size, and combinations thereof. The linear control formulae described herein may be manipulated to account for any one, combination of, or all of the aforementioned additional variables. For example, as bubble size of entrained air increases, the impact on drainage and runnability in the brown stock washing process decreases. Estimates of bubble size of entrained air can be obtained via an entrained air measurement device as described herein, with relative bubble size being a function of standard deviation of measured entrained air. Generally, for brown stock washing, relatively large numbers for bubble size (e.g., greater than about 5%) are better for drainage, as relatively large numbers indicate coalescence of relatively small bubbles into relatively large bubbles, thereby having less impact on drainage of the washed brown stock.

In certain aspects, the brown stock has relatively high consistency (e.g., greater than about 4%), which can impact drainage in the brown stock washing process and increase conductivity of the washed brown stock. Relatively high conductivity of the pulp can result in inefficient bleaching downstream from the brown stock washing process. Additionally, changes in charge of the pulp on the paper machine may take place, impacting drainage on the paper machine. The methods provided herein generally allow for pulp of relatively low conductivity across a range of consistency levels to be utilized in papermaking because consistent brown stock washing tends to provide consistent brown stock, which tends to improve bleaching and papermaking efficiency downstream.

In certain aspects, the method further comprises increasing the brown stock washer drum speed to prevent overflow of a washer vat of the brown stock washing process. Generally, as the brown stock drum runs more quickly, more pulp slurry is pulled onto the mat, thereby reducing the vat level.

In certain aspects, the method further comprises controlling shower flow of the papermaking process according to drainage aid dosage. With improvement in drainage of the pulp, more shower water can be added for better washing. As vat dilution increases, the displacement of washing improves, thereby improving efficiency of the brown stock washing process.

Generally, drainage aid is dosed to the brown stock washing process so that the washed pulp will have improved drainage properties during papermaking. The improved drainage properties are imparted to the pulp by reducing the surface tension of the water in the pulp slurry. As is known in the art, pulp being formed into paper must be reasonably wet in order to form a sheet. A sheet is formed at the wet end of a papermaking process, which then passes to the dry end of the process. Once a sheet is formed at the wet end of the papermaking process, it is preferred to remove as much water as possible in the wet press section prior to the dryer section. Removal of water in the wet press section prior to the steam-heated rollers of the dryer section allows the paper machine to run faster, thereby improving energy efficiency of the papermaking process.

The drainage aid dosed to pulp of the brown stock washing process can be any suitable drainage aid. Generally, the presence of drainage aid in the pulp allows for improved drainage of water from the sheet in the wet press section as compared to pulp lacking drainage aid. In certain embodiments of the methods provided herein, the drainage aid comprises a surfactant, a defoamer as described herein, a solvent, or combinations thereof. Examples of surfactants include, but are not limited to, nonionic surfactants and anionic surfactants, e.g., ethyleneamines (e.g., ethylenediamine, diethylenetriamine, triethylenetetramine, tetraethylenepentamine, piperazine, aminoethylpiperazine, ethyleneamine mixtures, such as mixtures of ethyleneamine oligomers, etc.). In certain embodiments of the methods provided herein, the solvent is suitable for removing lignin and/or other black liquor components, and is at least partially soluble or dispersible. Examples of such solvents include, but are not limited to, alcohols, ketones, heterocyclic compounds, polyethers, and the like, and mixtures thereof. Additionally, water may be utilized. In certain embodiments of the methods provided herein, the drainage aid comprises a polydimethylsiloxane ("PMDS")-containing composition.

In certain aspects, the dosing of the drainage aid is controlled via manipulation of a drainage aid delivery unit, e.g., a variable speed pump. For example, drainage aid can be dosed to the brown stock washing process via a variable speed pump. The methods and systems provided herein can be utilized to control the speed of the drainage aid variable speed pump.

Defoamer is dosed to pulp in the brown stock washing process so that entrained air can be released from the treated water in the pulp slurry. Generally, entrained air concentration should be minimized in the brown stock washing process, and in the papermaking process in general.

The defoamer dosed to pulp of the brown stock washing process can be any suitable defoamer. Generally, the presence of the defoamer in the process will allow for reduction of entrained air in the treated water present in the pulp slurry of the brown stock washing process. In certain embodiments of the methods provided herein, the defoamer is selected from a hydrocarbon, an oil, a fatty alcohol, a fatty ester, a fatty acid, a poly(alkylene oxide) (e.g., poly(ethylene oxide) or poly(propylene oxide), derivatives thereof, and copolymers thereof), an organic phosphate, hydrophobic silica (e.g., hydrophobic silica present in a hydrocarbon oil), a silicone-containing compound, and combinations thereof. In certain embodiments of the methods provided herein, the defoamer comprises a silicone-containing compound, and in certain embodiments, the silicone-containing compound is a PMDS-containing compound. In certain embodiments of the methods provided herein, the defoamer formulation is custom-determined onsite depending on one or more of several possible variables, including, for example, drainage aid chemistry, drainage aid concentration, and combinations thereof.

In certain aspects, the dosing of the defoamer is controlled via manipulation of a defoamer delivery unit, e.g., a variable speed pump. For example, defoamer can be dosed to the brown stock washing process via a variable speed pump. The methods and systems provided herein can be utilized to control the speed of the defoamer variable speed pump.

In some aspects, the defoamer comprises a hydrocarbon, an oil, a fatty alcohol, a fatty ester, a fatty acid, a poly (alkylene oxide), an organic phosphate, hydrophobic silica, a silicone-containing compound, and combinations thereof. In some aspects, the defoamer comprises a silicone-containing compound. An example of a silicone-containing compound is a PMDS-containing compound.

In some aspects, the method includes determining a chlorine dioxide dosage in a bleaching stage of a papermaking process based on the total black liquor carryover. An accurate estimate of the total black liquor carryover in the brown stock can enhance bleaching of the pulp because chlorine dioxide can be dosed appropriately.

A system for controlling dosing of an additive to a brown stock washing process is provided. The system includes a refractive index measurement device; a controller configured to receive data provided by the refractive index measurement device and transform the data into additive addition output instructions; and an additive delivery unit configured to receive and execute the additive addition output instructions from the controller.

Examples of a refractive index measurement device include, but are not limited to, a refractometer. The system may include other measurement devices such as, for example, a vat level detector, a shower flow measurement device, a shower conductivity measurement device, a drum thickener electrical current relay, or an entrained air bubble size detector. All measurement devices may be in communication with the controller.

In some aspects, the system includes a conductivity measurement device configured to measure conductivity of the brown stock. The conductivity measurement device is in communication with a controller that is configured to determine a total black liquor carryover in the brown stock based on at least two variables: a refractive index of the brown stock and a conductivity of the brown stock.

FIG. 1 is a schematic illustration of a brown stock washing process 100 comprising an embodiment of a system for controlling dosing of drainage aid and defoamer to a brown stock washing process 100. The brown stock washing process 100 comprises an inlet vat line 101 that carries the pulp and black liquor feedstock. The pulp is fed onto rotating drum 102 forming a pulp mat. The pulp mat is washed via shower 103, thereby forming washed mat. Shower water is fed to the shower 103 through a shower water inlet 106. Vacuum is drawn on the rotating drum 102 via filtrate tank 104, and the mat is removed from rotating drum 102, which can be fed to second rotating drum 105. Refractometers 108 can be placed at various positions in the process. For example, a refractometer 108 may be placed on the inlet vat line 101 or washed pulp line 107. A conductivity sensor 109 can be placed on the inlet vat line 101, weak black liquor line 110, or washed pulp line 107.

FIG. 1 depicts a refractometer 108 on the washed pulp line 107 connected to a refractometer relay 111. Each of the refractometers 108 shown in FIG. 1 may be connected to a refractometer relay 111 that is connected to a controller 112. The controller 112 receives input signals from the refractometers 108 and the conductivity sensors 109 and calculates the inorganic and organic fractions. This information is then used to control dosage of drainage aid and defoamer by sending a signal via the pump control relay 113 to a pump 114.

In some aspects, the brown stock washing process comprises a plurality of washers arranged in series as shown in FIG. 1. In some aspects, the method includes measuring the conductivity and the refractive index of the brown stock being fed to a first washer in the plurality of washers and measuring the conductivity and the refractive index of washed pulp leaving a last washer in the plurality of washers.

The refractometer and conductivity measurements from the sensors positioned at the inlet can be used in a feedforward control strategy, and/or the refractometer and conductivity measurements from the sensors positioned at the outlet can be used in a feedback control strategy.

In aspects where the process includes multiple washers, the back end washers may be controlled based on drum speed, wash water, or both, while the front end washers can be controlled based on refractometer and conductivity measurements of the inlet brown stock.

In some aspects, the active alkali concentration in the black liquor is monitored and adjusted. A proper control of the residual effective alkali concentration of the weak black liquor flowing from the digester can assure important benefits in the evaporators (i.e., more stable viscosity, less fouling) and in the recovery boiler (i.e., stable viscosity, spray size consistency).

The important properties of black liquor that affect the evaporation processes are viscosity, heat capacity, density, the boiling point elevation, surface tension and thermal conductivity. Having low residual effective alkali can cause high viscosity and precipitation of lignin. A minimum residual effective alkali of at least 6 g/l must be maintained to avoid lignin precipitation.

The viscosity of black liquors can be controlled by increasing the temperature or by adding alkali. Alkali addition to the digester or to the black liquor can reduce the viscosity of low-alkali content liquors. An important precaution is to neutralize acidic inputs such as chlorine dioxide generator effluent and tall oil brine into the evaporators set.

Fouling in an evaporator set occurs due to various mechanisms like lignin precipitation, fibers, soap fouling, soluble sodium scaling and insoluble calcium scaling. Scaling is a very serious problem that reduces the rate of heat transfer and evaporation in the multiple-effect evaporator plant.

Black liquors are characterized by high viscosity when the residual effective alkali is too low. The solids content also affects the spray characteristics of the black liquor and droplet size distribution of the black liquor through its effect on liquor properties such the viscosity. Uncontrolled drop size (i.e., too big) of the firing black liquor can cause serious blackouts of the furnace. Under practical conditions, the black liquor viscosity can be controlled by the addition of alkali, by oxidation and storage at high temperatures.

The data provided by the refractive index measurement device and/or conductivity measurement device may be utilized, for example, to provide input into controlling dosage of drainage aid to the brown stock. In certain aspects, the refractive index and/or conductivity relay provides an electrical input to the controller, which is then utilized to calculate the TDS.

The controller of the systems and methods provided herein is configured to receive data provided by, for example, the refractive index measurement device, the conductivity measurement device, and optionally the entrained air measurement device, the brown stock washer drum speed relay, the brown stock washer stock flow rate measuring device, other data-generating devices that may measure any one or combination of vat level, shower flow, shower conductivity, electrical current of the drum thickener, and entrained air bubble size. The controller is further configured to transform the data received into drainage aid output instructions and defoamer output instructions, which are subsequently delivered to a drainage aid delivery unit and a defoamer delivery unit.

Each of the devices measures its applicable variable and communicates the measurement in some form to the controller. The controller transforms the data into output instructions (e.g., drainage aid output instructions and defoamer output instructions).

The controller as provided herein refers to an electronic device having components such as a processor, memory device, digital storage medium, cathode ray tube, liquid crystal display, plasma display, touch screen, or other monitor, and/or other components. Controllers include, for example, an interactive interface that guides a user, provides prompts to the user, or provides information to the user regarding any portion of the method of the invention. Such information may include, for example, building of calibration models, data collection of one or more parameters, measurement location(s), management of resulting data sets, etc.

When utilized, the controller is preferably operable for integration and/or communication with one or more application-specific integrated circuits, programs, computer-executable instructions or algorithms, one or more hard-wired devices, wireless devices, and/or one or more mechanical devices such as liquid handlers, hydraulic arms, servos, or other devices. Moreover, the controller is operable to integrate feedback, feed-forward, or predictive loop(s) resulting from, inter alia, the parameters measured by practicing the method(s) of the present disclosure. Some or all of the controller system functions may be at a central location, such as a network server, for communication over a local area network, wide area network, wireless network, extranet, the Internet, microwave link, infrared link, and the like, and any combinations of such links or other suitable links. In addition, other components such as a signal conditioner or system monitor may be included to facilitate signal transmission and signal-processing algorithms.

By way of example, the controller is operable to implement the method of the invention in a semi-automated or fully-automated fashion. In another embodiment, the controller is operable to implement the method in a manual or semi-manual fashion. Examples of the aforementioned variations of the invention are provided herein in reference to the figures.

For example, a dataset collected from brown stock may include variables or system parameters, such as refractive index, conductivity, entrained air concentration, brown stock washer drum speed, brown stock washer stock flow, and other variables or system parameters described herein (e.g., whether determined empirically, automatically, measured directly, calculated, etc.). Such parameters are typically measured with any type of suitable data measuring/sensing/capturing equipment, such as described herein. Such data capturing equipment is preferably in communication with the controller and, according to alternative embodiments, may have advanced functions (including any part of control algorithms described herein) imparted by the controller.

Data transmission of any of the measured parameters or signals to a user, a drainage aid delivery unit (e.g., a drainage aid delivery pump), a defoamer delivery unit (e.g., a defoamer delivery pump), alarms, or other system components is accomplished using any suitable device, such as a wired or wireless network, cable, digital subscriber line, internet, etc. Any suitable interface standard(s), such as an Ethernet interface, wireless interface (e.g., IEEE 802.11a/b/g/n, 802.16, Bluetooth, optical, infrared, other radiofrequency, any other suitable wireless data transmission method, and any combinations of the foregoing), universal serial bus, telephone network, the like, and combinations of such interfaces/connections may be used. As used herein, the term "network" encompasses all of these data transmission methods.

Any of the components, devices, sensors, etc., herein described may be connected to one another and/or the controller using the above-described or other suitable interface or connection. In an embodiment, information (collectively referring to all of the inputs or outputs generated by the method of the invention) is received from the system and archived. In another embodiment, such information is processed according to a timetable or schedule. In a further embodiment, such information is processed in real-time. Such real-time reception may also include, for example, "streaming data" over a computer network. An example of a controller is a 3D TRASAR® control unit, available from Nalco Water, 1601 West Diehl Road, Naperville, IL 60563.

In certain embodiments of the systems and methods provided herein, a drainage aid delivery unit is configured to receive and execute the drainage aid output instructions from the controller. An embodiment of a drainage aid delivery unit is a pump, which may be a variable speed pump, arranged and configured to deliver an amount of drainage aid to the brown stock. For example, the drainage aid may be present in a tank, and the drainage aid delivery unit may be arranged and configured to remove drainage aid from the tank via a conduit and deliver the drainage aid to the brown stock. An example of a drainage aid delivery unit is a variable speed diaphragm pump.

In certain embodiments of the systems and methods provided herein, a defoamer delivery unit is configured to receive and execute the defoamer output instructions from the controller. An embodiment of a defoamer delivery unit is a pump, which may be a variable speed pump, arranged and configured to deliver an amount of defoamer to the brown stock. For example, the defoamer may be present in a tank, and the defoamer delivery unit may be arranged and configured to remove defoamer from the tank via a conduit and deliver the defoamer to the brown stock. An example of a defoamer delivery unit is a variable speed diaphragm pump.

The system may further comprise at least one of a vat level detector, a shower flow measurement device, a shower conductivity measurement device, a drum thickener electrical current relay, an entrained air bubble size detector, and combinations thereof, in communication with the controller.

EXAMPLES

Example 1

Figure 3:
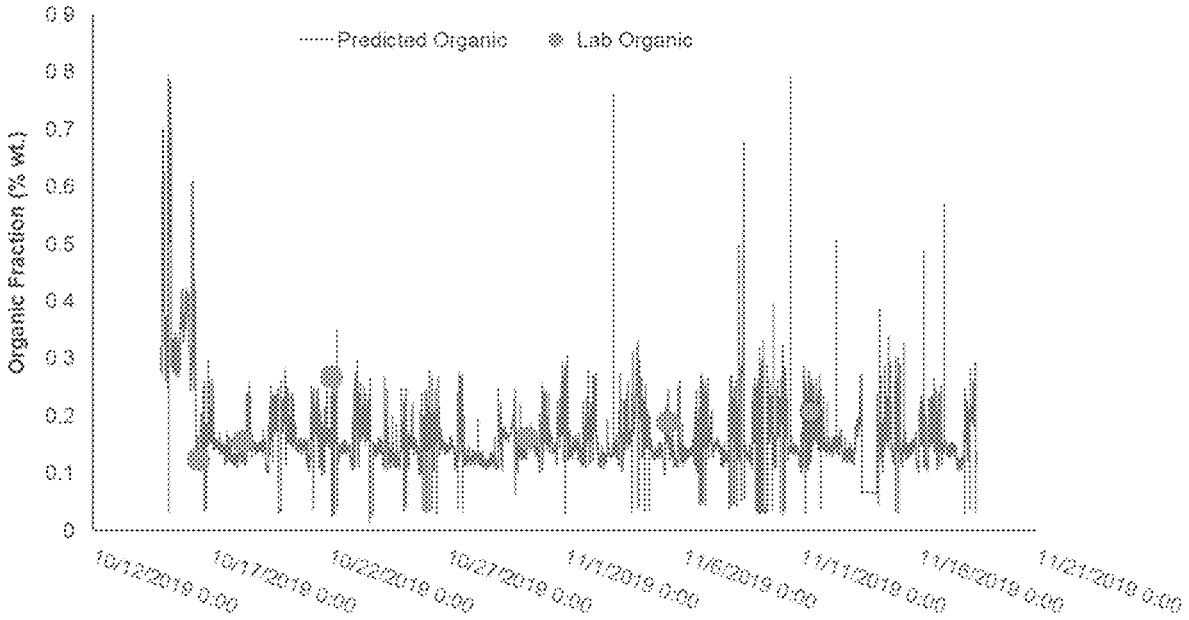
FIG. 3 shows the predicted organic loading multiple regression model for the online measurements utilizing the total dissolved solids and conductivity measurements.

Organic Loading Multiple Regression Model Development for the Online Measurements Between the Predicted and Gravimetric Organic Fraction Measurements FIG. 3 shows the predicted organic loading multiple regression model for the online measurements utilizing the total dissolved solids and conductivity measurements. Gravimetric analysis was conducted at selected times, and the organic fraction for these measurements is shown as circles in FIG. 3. These results show that the model correlates with the measured organic fraction in the lab.

Example 2

Measuring Organic Carryover in Brown Stock

Figure 4:
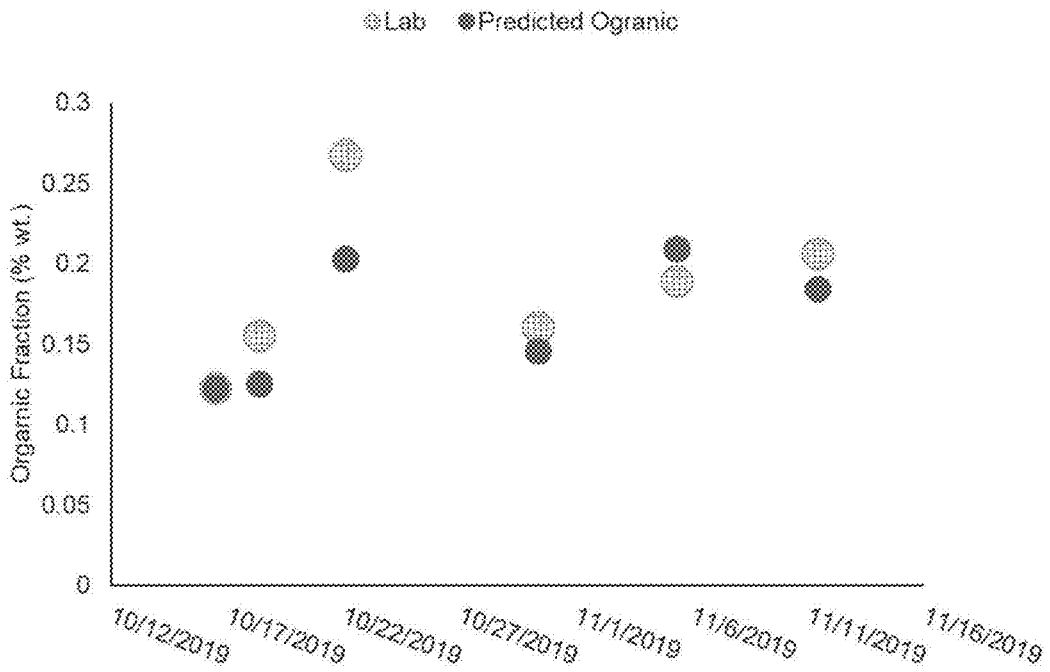
FIG. 4 shows a comparison of the predicted organic fraction to the lab result using gravimetric analysis.
Figure 5:
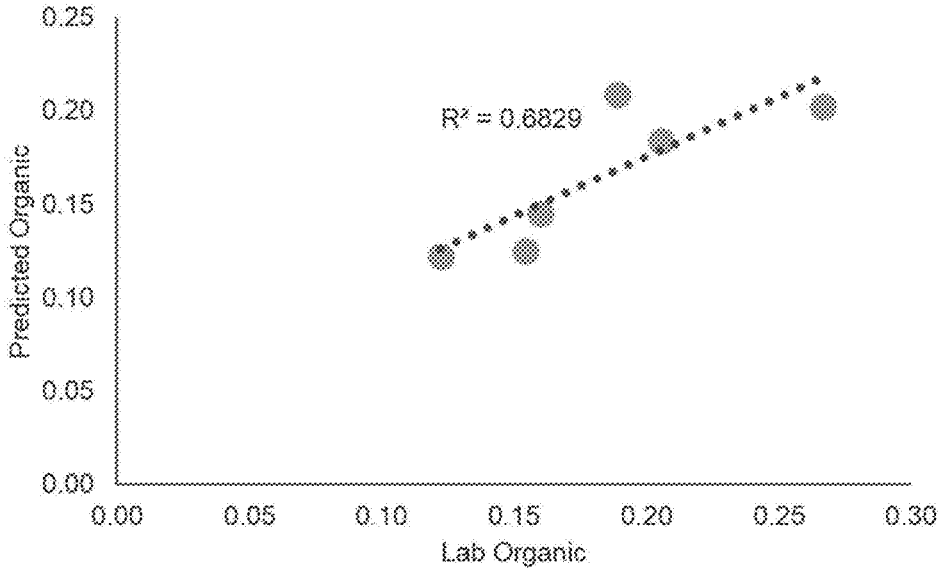
FIG. 5 shows predicted organic fraction versus lab-calculated organic.
Figure 6:
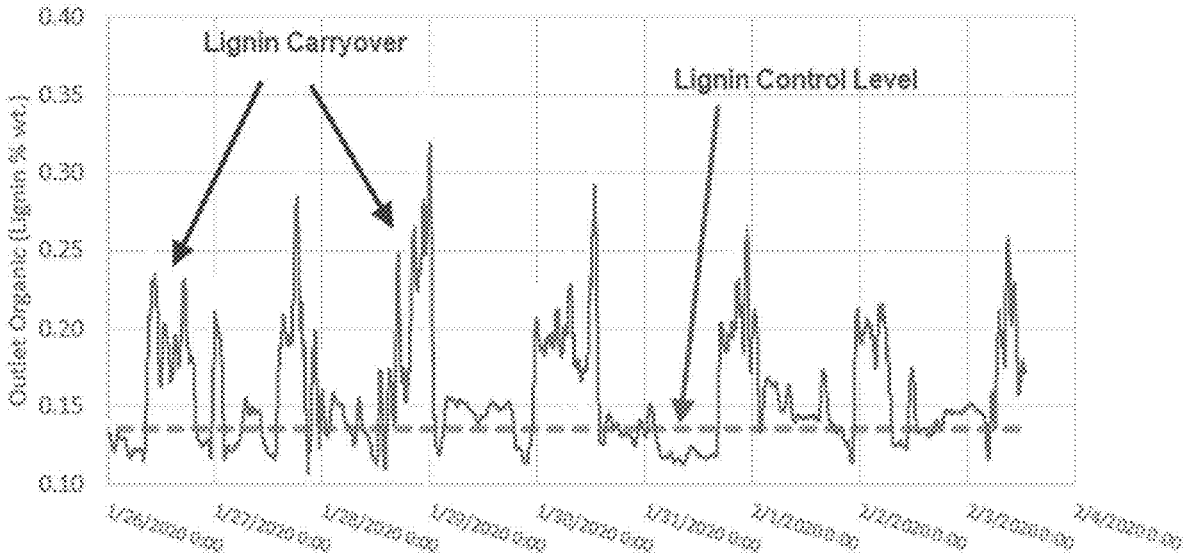
FIG. 6 shows organic carryover in the brown stock.
Figure 7:
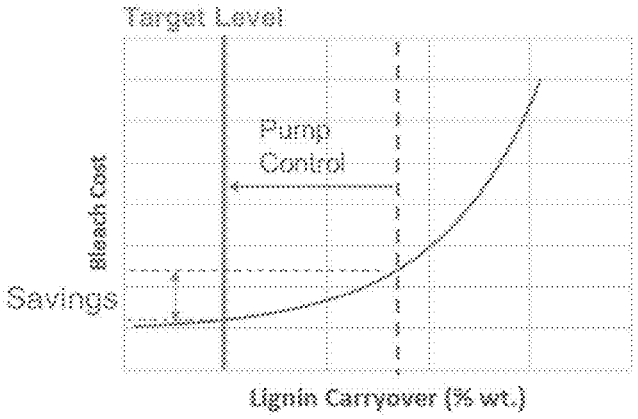
FIG. 7 shows savings in bleach cost when lignin carryover is accurately measured and controlled to the target level.

FIG. 4 shows a comparison of the predicted organic fraction to the lab result using gravimetric analysis, and FIG. 5 shows predicted organic fraction versus lab-calculated organic. The predicted organic data was determined by collecting refractometer measurements at the washer inlet.

High variability in organic carryover from Brown stock wash unit outlet was monitored in real time and minimized by organic wash aid pump control.

Overcoming the gaps in lignin measurement technology, it is now possible to monitor the lignin content from the outlet of brown stock wash unit as shown in FIG. 4. This input variable can be used as a feedback control using a specific organic wash aid chemistry to optimize brown stock wash unit operation or forward control to determine $ClO_2$ charge in $D_0$ and $D_1$ stages to optimize the bleaching chemical consumption. The bleach load based chemical charge control offers potential for optimization of $ClO_2$ due to opportunity to reduce variability and off grades and reducing bleaching chemicals costs.

Conventional washing efficiency measurements used in the industry give only a fraction of the information needed for washing monitoring, controlling, and optimization. It is generally believed that the washing efficiency of organics and inorganics in the wash liquor is not the same.

All of the compositions and methods disclosed and claimed herein can be made and executed without undue experimentation in light of the present disclosure. While this invention may be embodied in many different forms, there are described in detail herein specific preferred embodiments of the invention. The present disclosure is an exemplification of the principles of the invention and is not intended to limit the invention to the particular embodiments illustrated. In addition, unless expressly stated to the contrary, use of the term "a" is intended to include "at least one" or "one or more." For example, "a sensor" is intended to include "at least one sensor" or "one or more sensors."

Any ranges given either in absolute terms or in approximate terms are intended to encompass both, and any definitions used herein are intended to be clarifying and not limiting. Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all subranges (including all fractional and whole values) subsumed therein.

Any composition disclosed herein may comprise, consist of, or consist essentially of any element, component and/or ingredient disclosed herein or any combination of two or more of the elements, components or ingredients disclosed herein.

Any method disclosed herein may comprise, consist of, or consist essentially of any method step disclosed herein or any combination of two or more of the method steps disclosed herein.

The transitional phrase "comprising," which is synonymous with "including," "containing," or "characterized by," is inclusive or open-ended and does not exclude additional, un-recited elements, components, ingredients and/or method steps.

The transitional phrase "consisting of" excludes any element, component, ingredient, and/or method step not specified in the claim.

The transitional phrase "consisting essentially of" limits the scope of a claim to the specified elements, components, ingredients and/or steps, as well as those that do not materially affect the basic and novel characteristic(s) of the claimed invention.

As used herein, the term "about" refers to the cited value being within the errors arising from the standard deviation found in their respective testing measurements, and if those errors cannot be determined, then "about" may refer to, for example, within 5% of the cited value.

Furthermore, the invention encompasses any and all possible combinations of some or all of the various embodiments described herein. It should also be understood that various changes and modifications to the presently preferred embodiments described herein will be apparent to those skilled in the art. Such changes and modifications can be made without departing from the spirit and scope of the invention and without diminishing its intended advantages. It is therefore intended that such changes and modifications be covered by the appended claims.

What is claimed is:

1. A method of treating brown stock in a brown stock washing process, comprising:

measuring a refractive index of a brown stock;

measuring a conductivity of the brown stock;

determining total dissolved solids from the refractive index of the brown stock;

determining a total black liquor carryover comprising an organic fraction and an inorganic fraction in the brown stock based on the refractive index of the brown stock and the conductivity of the brown stock;

determining the organic fraction and the inorganic fraction based on the refractive index of the brown stock and the total dissolved solids of the brown stock; and dosing an additive to the brown stock according to at least the refractive index and the conductivity of the brown stock.

2. The method of claim 1, wherein the conductivity of the brown stock is measured by implementing a conductivity sensor.

3. The method of claim 1, wherein the inorganic fraction is determined based on formula (I):

$$\text{Inorganic (\% wt.)} = \text{Constant} + B^{*}\text{Conductivity (mS/cm)} + A^{*}\text{TDS (\% wt.)} \quad \text{(I)},$$

where A and B are parameters determined from a fit of the data to gravimetric measurements of the brown stock and where TDS is a total dissolved solids measurement based on the refractive index of the brown stock.

4. The method of claim 1, wherein the organic fraction is determined using a formula that is a function of the conductivity of the brown stock and a total dissolved solids in the brown stock.

5. The method of claim 1, wherein the additive comprises a drainage aid.

6. The method of claim 1, wherein the additive comprises a defoamer.

7. The method of claim 6, wherein the defoamer comprises a hydrocarbon, an oil, a fatty alcohol, a fatty ester, a fatty acid, a poly(alkylene oxide), an organic phosphate, hydrophobic silica, a silicone-containing compound, and combinations thereof.

8. The method of claim 7, wherein the silicone-containing compound is a polydimethylsiloxane-containing compound.

9. The method of claim 1, further comprising determining a chlorine dioxide dosage in a bleaching stage of a papermaking process based on the total black liquor carryover.

10. The method of claim 1, wherein the brown stock washing process comprises a plurality of washers arranged in series.

11. The method of claim 10, further comprising measuring the conductivity and the refractive index of the brown stock being fed to a first washer in the plurality of washers and measuring the conductivity and the refractive index of washed pulp leaving a last washer in the plurality of washers.

12. The method of claim 1, further comprising monitoring a brown stock washer drum speed, a brown stock washer stock flow, or a combination thereof.

13. The method of claim 12, wherein the brown stock washer drum speed is from about 1 rpm to about 5 rpm, and wherein the brown stock washer stock flow is maintained to provide a brown stock consistency of from about 1% to about 4%.

14. A system for controlling dosing of an additive to a brown stock washing process, comprising:

a refractive index measurement device;

a conductivity measurement device;

a controller configured to receive data provided by the refractive index measurement device and the conductivity measurement device, and transform the data into additive addition output instructions, wherein the controller is configured to determine a total black liquor carryover in the brown stock based on a refractive index of the brown stock and a conductivity of the brown stock; and an additive delivery unit configured to receive and execute the additive addition output instructions from the controller after receiving data from the refractive index measurement device and the conductivity measurement device.

15. The system of claim 14, wherein the system further comprises at least one of a vat level detector, a shower flow measurement device, a shower conductivity measurement device, a drum thickener electrical current relay, an entrained air and bubble size detector, and combinations thereof, in communication with the controller.

16. The system of claim 14, wherein the refractive index of the brown stock and the conductivity of the brown stock can be used in a feedforward control strategy, and/or the refractive index of the brown stock and the conductivity of the brown stock can be used in a feedback control strategy.

17. A method of treating brown stock in a brown stock washing process, comprising:

measuring a refractive index of a brown stock;

measuring a conductivity of the brown stock;

determining an inorganic fraction and an organic fraction based on the refractive index of the brown stock and the conductivity of the brown stock, wherein a total black liquor carryover comprises the organic fraction and the inorganic fraction; and dosing an additive to the brown stock after measuring the refractive index and the conductivity of the brown stock.

18. The method of claim 17, further comprising determining the total black liquor carryover in the brown stock based on at least the refractive index of the brown stock and the conductivity of the brown stock.

19. The method of claim 17, further comprising determining total dissolved solids from the refractive index of the brown stock.

20. The method of claim 17, wherein the inorganic fraction is determined based on formula (I):

$$\text{Inorganic (\% wt.)} = \text{Constant} + B^{*}\text{Conductivity (mS/cm)} + A^{*}\text{TDS (\% wt.)} \quad \text{(I)},$$

where A and B are parameters determined from a fit of the data to gravimetric measurements of the brown stock and where TDS is a total dissolved solids measurement based on the refractive index of the brown stock, and wherein the organic fraction is determined based on formula (II):

$$\text{Organic (\% wt.)} = \text{TDS (\% wt.)} - \text{Inorganic (\% wt.)} \quad \text{(II)}.$$

* * * * *